United States Patent [19]

Berg et al.

[11] 4,430,535

[45] Feb. 7, 1984

[54] DAMPING DEVICE FOR ELECTRIC CIRCUIT BREAKERS

[75] Inventors: Samuel Berg; Carl E. Sölver, both of Ludvika, Sweden

[73] Assignee: ASEA Aktiebolag, Västerås, Sweden

[21] Appl. No.: 323,572

[22] Filed: Nov. 20, 1981

[30] Foreign Application Priority Data

Nov. 27, 1980 [SE] Sweden ..... 8008317

[51] Int. Cl.[3] ..... H01H 35/38

[52] U.S. Cl. ..... 200/82 R; 200/34; 200/325

[58] Field of Search ..... 200/81 R, 82 R, 82 B, 200/34, 318, 324, 325; 91/394, 396; 92/8, 9

[56] References Cited

U.S. PATENT DOCUMENTS

| | | | |
|---|---|---|---|
| 2,452,762 | 11/1948 | Karow | 200/34 |
| 2,783,338 | 2/1957 | Beatty | 200/34 |
| 3,793,498 | 2/1974 | Matsui | 200/82 R |
| 4,178,491 | 12/1979 | Orscheln | 200/34 |

FOREIGN PATENT DOCUMENTS

| | | |
|---|---|---|
| 706662 | 5/1941 | Fed. Rep. of Germany . |
| 914026 | 6/1954 | Fed. Rep. of Germany . |

*Primary Examiner*—G. P. Tolin

*Attorney, Agent, or Firm*—Watson, Cole, Grindle & Watson

[57] ABSTRACT

The invention relates to an oil damping device intended to be used in operating mechanisms for puffer-type $SF_6$ breakers where there is a risk that the contact movement is reversed during an opening operation with great current. The damping device comprises a piston which is attached to a piston rod and is movable in a damping cylinder. The damping device is double-acting and the movement is damped against the two end positions of the piston (corresponding to the closed and open position, respectively, of the circuit breaker) by forcing oil to flow out through restricted openings in the damping cylinder. The damping cylinder is movable inside an additional cylinder between a rest position and a lock position. Upon an opening operation, the damping cylinder is automatically brought to the lock position where it is temporarily retained by a latching member. With the damping cylinder in this position, the restricted openings arranged on the closed position side of the piston are closed, such that the piston is prevented from moving in the closing position. By providing the damping device with a nonreturn latching member, a higher breaking capacity of the circuit breaker can be achieved.

4 Claims, 2 Drawing Figures

DAMPING DEVICE FOR ELECTRIC CIRCUIT BREAKERS

BACKGROUND OF THE INVENTION

1. Field of the Invention

The present invention relates to damping devices for electric circuit breakers, and in particular for gas insulated high voltage circuit breakers of the so-called puffer-type.

2. Prior Art

In connection with electric circuit breakers it is previously known to use damping devices of the type which comprises a housing filled with a damping liquid and comprising a displaceably arranged damping cylinder, in which a piston which is connectible to the movable contact of a circuit breaker is displaceable between a first and a second end position corresponding to the closed and open positions, respectively, of the circuit breaker. The piston limits two cylinder spaces positioned on opposite sides of the piston and having restricted outlet openings. Damping devices of this type have been described, for example, in the German Patent Specifications Nos. 706,622 and 914,026.

When breaking a great current with a puffer-type $SF_6$ circuit breaker, a high pressure is generated in the puffer cylinder during the latter stage of the opening movement by the arc in the circuit breaker partially blocking the gas flow path. This high pressure causes a counter force which may for a brief period exceed the driving force of the operating mechanism. The counter force results in the opening movement being slowed down. In extreme cases the breaker movement may become reversed. Such a reversal of the opening movement reduces the breaking capacity of the circuit breaker very considerably by causing the pressure in the puffer cylinder to become low.

SUMMARY OF THE INVENTION

The present invention aims to provide a solution to the above-mentioned problems in connection with electric circuit breakers, preferably in puffer-type $SF_6$ circuit breakers, where there is a risk that the contact movement becomes reversed during an opening operation with great current. This is achieved by providing the operating mechanisms of the circuit breaker with a damping device which comprises a housing filled with a damping liquid and comprising a displaceably arranged damping cylinder, in which a piston which is connectable to the movable contact of the circuit breaker is displaceable between a first and second end position corresponding to the closed and open positions, respectively, of the circuit breaker, the piston limiting two cylinder spaces positioned on opposite sides of the piston and having restricted outlet openings, the damping cylinder being arranged, upon displacement of the piston from the first to the second end position, to be displaced against the action of a spring to a lock position, in which the restricted openings, leading from the cylinder space on the closed position side of the piston, are blocked, thus preventing the reversal of the piston. By providing the damping device according to the invention with a nonreturn latching function, which is activated when opening the circuit breaker, the movable contact of the circuit breaker is prevented from becoming reversed, whereby the breaking capacity is improved.

BRIEF DESCRIPTION OF THE DRAWING

One embodiment of the invention is shown in the accompanying drawing, in which.

DESCRIPTION OF THE PREFERRED EMBODIMENT

Figure 1:
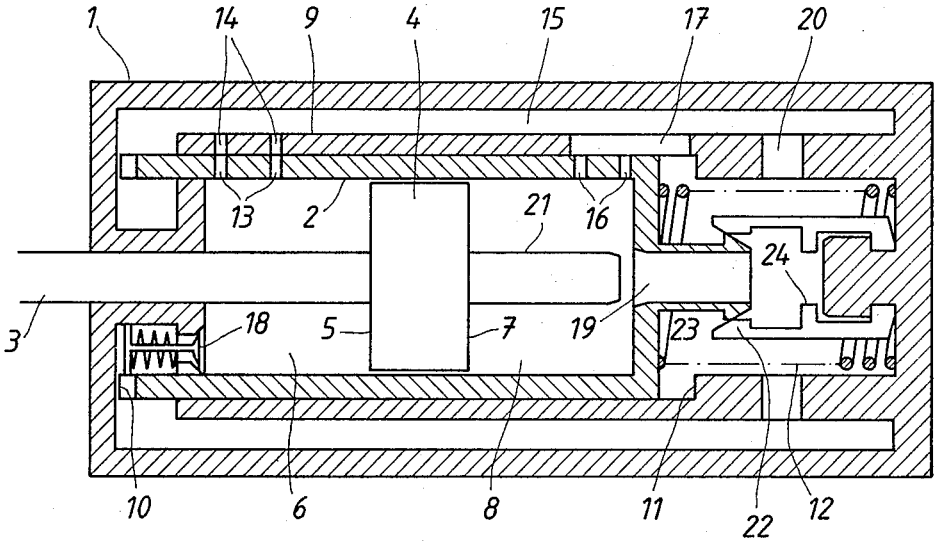
FIG. 1 shows an axial section through an oil damping device with a nonreturn latch member.

The damping device shown in FIG. 1 is intended to be used in operating mechanisms (e.g. pneumatic operating mechanisms) for puffer-type $SF_6$ circuit breakers. The damping device comprises an oil-filled cylindrical housing 1 comprising a damping cylinder 2, in which a piston 4 attached to a piston rod 3 is movable between two end positions. The drawing shows the piston in an intermediate position during a displacement operation between the first end position at the left-hand end of the cylinder 2 and the second end position at the right-hand end of the cylinder. The damping device is intended to be connected, via the piston rod 3, to the movable contact of a puffer-type circuit breaker in such a way that the first end position of the damping piston corresponds to the closed position of the circuit breaker and the second end position corresponds to the open position of the circuit breaker. The left-hand side 5 of the piston, referred to below as the closed-position side, limits a first cylinder space 6 and the right-hand side 7 of the piston, referred to below as the open-position side, limits a second cylinder space 8. The damping cylinder 2 is movable inside a guiding cylinder 9 between two end positions defined by two stops 10 and 11. In the rest position, the damping cylinder is held against the stop 10 by a spring 12.

The cylinder space 6 on the closed-position side of the piston is provided with restricted openings 12, which in the rest position of the damping cylinder are positioned aligned with corresponding openings 14 in the guiding cylinder 9, which openings open out into an annular space 15 located outside the guiding cylinder. The cylinder space 8 on the open-position side of the piston is provided with similar restricted openings 16, which by way of a larger opening 17 in the guiding cylinder 9 always open out into the outer space 15, independently of the position of the damping cylinder 2. Between the outer space 15 and the cylinder space 6 on the closed-position side of the piston there is arranged a nonreturn valve 18, which permits free supply of oil to the cylinder space 6. In the rest position of the damping cylinder, the cylinder space 8 on the open-position side of the piston communicates with the outer space 15 via an opening 19, which is oriented in the axial direction of the damping cylinder, and radial communication openings 20 in the cylinder 9.

The damping device is double-acting and damps the movement towards the two end positions by forcing oil to flow out through the restricted openings 13 and 16, respectively, which are gradually blocked by the piston 4 when it approaches the end positions.

When the damping piston 4 is moved to the left (closing operation) the damping cylinder 2 remains in its rest position and the movement is damped in the normal manner by restricting the oil flow in the opening 13. The nonreturn valve 18 is then closed.

When the damping piston 4 is moved to the right (opening operation), an oil pressure is formed during the latter stage of the stroke, when a plunger 21 arranged on the piston 4 seals the opening 19, which oil pressure is sufficient to move the damping cylinder 2 to the right until it reaches the end stop 11. In this position the cylinder 2 is retained by spring-biased latches 22 which engage behind projections 23 on the cylinder 2. With the cylinder 2 in this position, the openings 13 are closed and this means that the piston 4 is prevented from moving to the left (in the closing direction) if it should tend to do so. During a rightward movement (in the opening direction), damping takes place in the normal manner by restricting the oil flow in the openings 16, which are not blocked. When the piston reaches its right end position, the plunger 21 presses out the latches 22 via projections 24 arranged on the latches 22 and releases the cylinder 2, whereupon the cylinder 2, under the influence of the spring 12, will rest with its end surface against the piston 4. When the piston is moved to the left next time, the cylinder 2 is returned to its initial position (the stop 10) by the spring 12.

Figure 2:
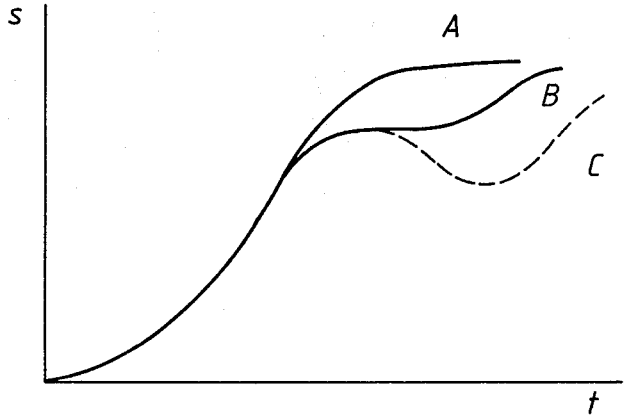
FIG. 2 shows examples of curves of the contact movement as a function of time when using damping devices with and without a nonreturn latch member.

FIG. 2 shows the contact movement 5 of a puffer-type circuit breaker as a function of time t in case of an opening movement in no load operation (curve A), when breaking a great current with a nonreturn latch according to the invention (curve B), and when breaking a great current without a nonreturn latch (curve C).

What is claimed is:

1. A damping device for electric circuit breakers, said damping device comprising: a housing (1) filled with a damping liquid, a damping cylinder (2) within said housing, said cylinder being movable in its axial direction, a piston (4) within said cylinder, said piston being connectible to the movable contact of a circuit breaker and being movable between a first end position and a second end position, said first and second end positions corresponding to the closed and open positions of the circuit breaker, respectively, said piston limiting two cylinder spaces (6, 8) positioned on opposite sides of the piston and having restricted outlet openings (13, 16), a spring means (12) for biasing said damping cylinder axially, said damping cylinder being moved by said piston against the action of said spring means to a lock position when said piston is moved from said first to said second end position, latching means (22) for retaining the damping cylinder (2) in said lock position, said outlet openings of the cylinder space on that side of the piston facing said first end position being blocked in said locking position, whereby reverse movement of the piston is prevented.

2. A damping device according to claim 1, wherein said piston (4) supports a plunger (21) or the like, which is arranged, in said second end position of the piston, to influence said latching member (22) for releasing the damping cylinder (2).

3. A damping device according to claim 1, wherein said damping cylinder (2) is movable inside a guiding cylinder (9) which is fixedly joined to the damping device housing (1) and in which are arranged restricted openings (14) which in the rest position of the damping cylinder (2) are positioned in alignment with the restricted openings (13) in the cylinder space (6) located on the closed-position side (5) of the piston.

4. A damping device according to claim 1, wherein said restricted openings (13, 16) open out into a space (15) located between the damping cylinder (2) and the wall of the housing (1) of the damping device, a nonreturn valve (18) being arranged between said space (15) and the cylinder space (6) on the closed-position side (5) of the piston for free supply of liquid to said cylinder space (6).

* * * * *